United States Patent [19]

Feldstein

[11] 4,284,666

[45] * Aug. 18, 1981

[54] PROCESS FOR METAL DEPOSITION OF A NON-CONDUCTOR SUBSTRATE

[76] Inventor: Nathan Feldstein, 63 Hemlock Cir., Princeton, N.J. 08540

[ * ] Notice: The portion of the term of this patent subsequent to Jan. 1, 1997, has been disclaimed.

[21] Appl. No.: 106,916

[22] Filed: Dec. 26, 1979

Related U.S. Application Data

[60] Division of Ser. No. 817,242, Jul. 20, 1977, Pat. No. 4,181,759, which is a continuation-in-part of Ser. No. 712,131, Aug. 5, 1976, abandoned.

[51] Int. Cl.[3] ..... B05D 3/04; B05D 3/10; C23C 3/02

[52] U.S. Cl. ..... 427/304; 427/305; 427/306; 427/437; 427/438; 106/1.11

[58] Field of Search ..... 427/92, 98, 304, 305, 427/306, 437, 438; 106/1.11, 1.22, 1.23, 1.24

[56] References Cited

U.S. PATENT DOCUMENTS

| | | | |
|---|---|---|---|
| 3,841,881 | 10/1974 | Feldstein et al. | 427/306 |
| 3,962,497 | 6/1976 | Doty et al. | 427/306 |
| 4,181,759 | 1/1980 | Feldstein | 427/305 |

*Primary Examiner*—Ronald H. Smith
*Assistant Examiner*—Richard Bueker

[57] ABSTRACT

A process for the preparation of non-conductors prior to electroless metal plating with a catalyst composition. The catalyst formulation comprises the product resulting from the admixture of an acid, a nucleophillic reactant, stannous ions, a hydrolyzable stannic compound, and precious metal ions. The stannous ions are in a molar excess relative to either the stannic compound or the precious metal ions.

8 Claims, No Drawings

PROCESS FOR METAL DEPOSITION OF A NON-CONDUCTOR SUBSTRATE

This is a division of application Ser. No. 817,242 filed July 20, 1977, now U.S. Pat. No. 4,181,759 which is a continuation-in-part of Ser. No. 712,131 filed on Aug. 5th, 1976, now abandoned.

BACKGROUND OF THE INVENTION

The present invention relates to electroless plating processes and in particular to the method of treating non-conductors for the reception of electroless coating thereon.

Methods for the catalytic treatment of non-conductor dielectric substrates receptive for electroless plating are well known in the art.

In the past, two basic procedures have been adopted, both resulting in a catalytic surface capable of electroless plating initiation. The first procedure involves a two step process of immersion into an acidic solution comprising stannous ions followed by an immersion into a solution comprising noble metal ions such as palladium. In the alternate procedure, immersion into an acidic solution containing stannous and palladium ions is made with a second step (acceleration) which is optional.

The latter procedure has been described in U.S. Pat. No. 3,011,920 consisting of an admixture of tin(II) and Pd(II) which exists as a colloidal suspension resulting from the formation of metallic palladium nuclei which is stabilized by the excess tin(II) ions. It is noted, however, that in U.S. Pat. Nos. 3,672,938; 3,682,671; and 3,672,923 the same admixture was found and claimed to be a true solution rather than a colloidal suspension. In the latter patents the tin(II) and palladium(II) react to form an ionic complex product. In U.S. Pat. No. 3,841,881 an improvement related to composition of tin(II) and palladium(II) has been achieved through the extraneous addition of a product derived from separately aging stannic chloride. Several publications are available describing the chemistry which takes place within the aging process and the subsequent chemical interactions; these references are thus made part of this application.

1. N. Feldstein et al, J. Electrochem. Soc., 119, 1486 (1972).
2. N. Feldstein et al, Plating, 59, 140 (1972).
3. N. Feldstein et al, J. Electrochem. Soc., 119, 668 (1972).
4. N. Feldstein et al, U.S. Pat. No. 3,666,527.
5. N. Feldstein et al, J. Electrochem. Soc., 120, 475 (1973).
6. N. Feldstein, "Proc. of the AES Fourth Plating in the Electronics Industry Symposium, "Indianapolis, Indiana (1973).
7. N. Feldstein et al, J. Electrochem. Soc., 120, 875 (1973).
8. N. Feldstein et al, J. Electrochem. Soc., 121, 738 (1974).
9. L. Pytlewski, U.S. Pat. No. 3,890,429.

While there were many advantages associated with the incorporation of the aged tin(IV) product, some disadvantages have been encountered in practical operation. Specifically, it has been observed that the properties of the aged tin(IV) suspension are time dependent (even if the product is kept at room temperature). This behavior is noted in the performance of the product, thereby requiring continuous changes in the actual amount to be used as taught in U.S. Pat. No. 3,841,881. In a recent publication, B. K. W. Baylis et al, J. Electrochem. Soc., 123, p. 349 (1976) (see Table I) the time variant properties of aged tin(IV) are described as related to plating performance. Such variations are highly undesirable, for practical operation, especially whenever inventory of product is kept. In addition, it has been noted that concentrated solutions of tin(IV) are not efficient with respect to the aging process (see reference 1, FIGS. 1 & 2).

The present invention relates to improvement of the catalytic composition for electroless plating. In particular, the present invention reduces the number of concentrate stock solutions required. At the same time, the present invention provides the beneficial effects associated with the aged tin(IV) product and yet significantly minimizes the inherent variations of such product when produced separately (as taught in the prior art).

SUMMARY OF THE INVENTION

A method for the preparation of an effective catalytic formulation resulting through (a) admixing 1. stannous ions in a molar concentration excess to precious metal ions and in a molar excess to hydrolyzable stannic ions, with
2. precious metal ions, and
3. readily hydrolyzable stannic ions, and
4. an acid, and then (b) exposing said mixture to thermal energy.

The invention includes the composition resulting from carrying out the aforementioned process which composition is colloidal in nature.

DESCRIPTION OF PREFERRED EMBODIMENT

In the present invention, it has been recognized that effective catalytic compositions may be prepared by admixing the following key chemical components and then exposing the mixture to thermal energy. The mixture comprises:

A. a salt of a noble catalytic metal (e.g. palladium, platinum, rhodium, gold, etc.)

B. a salt of the stannous ions generally in molar excess relative to the catalytic metal C. an acid (preferably hydrochloric acid)

D. a readily hydrolyzable compound of tin(IV), e.g., $SnCl_4$; the molar concentration of which is lower relative to the stannous ions.

I have found that just mixing the above key ingredients is not sufficient. In particular, I have recognized that energy must be added to this admixture in order to yield an effective catalyst. This requirement is believed to be governed by the endothermic nature of the reaction $$\text{tin(IV)} \rightarrow \text{aged tin(IV)}$$

While no thermodynamic data is available related to the free energy of the product formed, due to its endothermic nature it should be obvious that the reaction time required for the above reaction is inversely related to RT, where R is a universal constant, and T is absolute temperature in °K.

While heating is therefore preferable to shorten reaction time, heating is not necessarily required, if one is willing to leave the reactants mixed for an extended period prior to use. While I do not wish to be bound by theory, the following key reactions are believed to govern the new composition which improves and overcomes the disadvantages of the method described in U.S. Pat. No. 3,841,881.

$$n_1\text{tin(IV)} \underset{k_{-1}}{\overset{k_1(\text{heat})}{\rightleftharpoons}} (n_1 - x)\text{ aged tin(IV)} \quad 1.$$

$$(n_1 - x)\text{ aged tin(IV)} + n_2\text{tin(II)} \underset{k_{-2}}{\overset{k_2}{\rightleftharpoons}} \text{reaction product} \quad 2.$$

$$\text{aged tin(IV)} + \text{N.R.} \underset{k_{-3}}{\overset{k_3}{\rightleftharpoons}} \text{modified aged tin(IV)} \quad 3.$$

where $n_2 > n_1$ and $k_2 >> k_1$ and N.R. denotes a nucleophilic reactant.

It is believed that as thermal energy is supplied to the admixture, the hydrolyzable tin(IV) reacts chemically to form the aged tin(IV) product. This product is a colloidal sol (polymerized form of tin(IV) ). The extent of polymerization depends upon concentration, time, temperature and pH. However, as the aged tin(IV) product is formed within the solution it spontaneously reacts with tin(II) (or a radical comprising tin(II), e.g., $SnCl_3^-$). I have recognized that due to the spontaneous nature of the latter reaction the aged tin(IV) product formed is quenched. Hence, this aged product is not capable of further aging (polymerization), i.e., chain propagation). Furthermore, the quenching reaction via tin(II) insures that as the colloids are formed they remain small in size rather than producing longer sized colloids, the latter of which are less effective for plating catalysts.

I have also recognized that formation and quenching of the aged tin(IV) product could not only take place within a composition in which the tin(II) is in excess to tin(IV) and not vice versa. The resulting compositions may be prepared in concentrate form or dried by the removal of the solvent (i.e. water).

The following examples illustrate the compositions and method of preparation of the improved catalyst formulation. The catalysts prepared were also evaluated as part of the plating process.

The evaluation consisted of:

1. Immersion of etched ABS into the catalytic composition for about 4 minutes at room temperature and water rinse.
2. Immersion in an accelerator solution for 2 minutes at 42° C. comprising 10% $HBF_4$ and water rinsing. It is clear that other accelerators (acids, alkaline) may be used with or without reducing agent.
3. Immersion into a room temperature Ni-B bath derived from a composition comprising nickel ions, pyrophosphate ammonia and dimethylamine borane. It is clear that other electroless baths may be used instead of copper, cobalt, etc.

EXAMPLE 1

| | |
|---|---|
| Water | 600 ml |
| palladium chloride | 0.75 g/l |
| stannic chloride . $5H_2O$ | 2 g/l |
| stannous chloride . $2H_2O$ | 30 g/l |
| HCl (conc.) | 50 ml/l (total) |

-continued

| | |
|---|---|
| water to final volume of | 1 liter |

In this example, the addition of chemicals was made essentially in the same order as written except that the palladium chloride and stannous chloride were taken from concentrates consisting of conc. HCl.

Vigorous agitation was made especially during the addition of all components and was maintained during the reaction period. After sufficient thermal energy was added to the admixture by heating a resulting dark brown color was noted at which point the heat source was removed.

It should be recognized that in the addition of the reactants many combinations can be made. For example: the tin(II) and tin(IV) may be combined into one source; the tin(IV) may be combined with the acidic palladium(II) and heated first, the addition of tin(II) to either tin(IV) and/or palladium(II) composition may be broken to at least two stages of additions. Moreover, it is possible to use all reacting streams heated. Such combinations are strictly a matter of refinement of the present formulation and their execution falls within the spirit of this invention.

EXAMPLE 2

The composition resulting in Example 1 was diluted 3× with water and saturated with sodium bromide. Effective plating was noted.

EXAMPLE 3

The composition of Example 1 was diluted 3× with water in the presence of 0.1 molar sodium laurylsulfate. This anionic surfactant is one of many available commercially. The plating results of this composition were not as good as in Example 2.

I have also prepared compositions similar to Example 1 and 2 (with and without added $SnCl_4$ and with and without the nucleophilic reactant) in which few percent of formaldehyde was incorporated. It is noted that formaldehyde is not an effective reducing agent in acidic media ("inactive state"); however, it is a reducing agent in alkaline media ("active state"). The latter medium has been used in the accelerator step. Other reducing agents of similar behavior to formaldehyde are known in the art (e.g. hydrazine). Incorporation of such reducing agents to other colloidal catalytic compositions of either precious or non-precious based metals falls within the spirit of this invention. It is, however, noted that the actual concentration for a specific system must be determined by trial experiments and cannot be predicted a priori. Such experiments can be readily carried forth by one of sufficient skill in this art.

In addition, I have also incorporated some nickel nitrate in similar fashion to Example 2. In general monovalent cations are preferred whenever negative colloids are employed.

I have also recognized that the aged tin(IV) product can react with extraneous nucleophilic reactants resulting in a modified form of the aged tin(IV) product. The reaction in part is believed to be a displacement of labile hydroxyl ions and/or water which are attached to aged tin(IV) skeleton product. These nucleophilic reactants can further enhance the effectiveness of the formulation through change in the zeta potential.

While I do not wish to be bound by theory, I have thus recognized that a wide variety of nucleophilic materials (electron rich) may be used to react with the aged tin(IV) product and thereby alter the charge distribution within the colloidal double layer. Typical potential nucleophilic materials (reactants) are: water, alcohol, halides (soluble chlorides and bromides), cyanide, nitrate, thiocyanate, nitrites, thiosulfate, ethoxides, carbanions, anionic surfactants, thiourea, etc. Generally speaking, these materials possess at least one lone pair of electrons.

It should further be recognized that an ideal nucleophilic reactant should be large and easily polarizable (such as iodide ions); moreover, in selecting a specific nucleophilic reactant to the present system (composition of matter) full consideration must be given as to its compatibility with all other components present within the chemical catalytic system and the catalytic phenomenon. Specifically, one skilled in the art should insure for instance that the nucleophilic reactant does not cause precipitation of the cations, a charge reversal of the colloids, etc. Generally speaking since the nucleophilic reactant reacts with the aged tin(IV) product, its incorporation should be made after sufficient thermal energy has been supplied resulting in the aged tin(IV) formation. While the nucleophilic reactant is primarily intended for the interaction with the aged tin(IV) it can also reactant with the other components present.

The exact concentration of a specific nucleophilic reactant (additive) cannot be determined a priori (since knowledge of equilibria constants is not available); however, such values can be determined by simple experimentation of controlled additions. It is however anticipated due to the equilibria reaction that the performance would be improved as the concentration of the additive is increased, probably leading to a saturation level. It is also noted that depending on the chemical nature of the nucleophilic reactant, acidity adjustment may be required.

While it is generally preferred to add from an auxilliary source the hydrolyzable stannic compound, I have also recognized that at times one may avoid using the auxilliary source and instead convert (by oxidation) a portion of the stannous component to the stannic oxidation state: Such approach or any other leading to the presence of hydrolyzable stannic compound clearly falls within the spirit of the present invention.

It would further seem that readily hydrolyzable compounds are generally of the halide type. This characteristic was vaguely implied for instance in U.S. Pat. No. 2,439,645 ( col 1 lines 45–50). Also see B. Jirgensons and M. E. Straumanis, "A Short Textbook of Colloid Chemistry," p. 447, 2nd revised and enlarged edition, The MacMillan Company, New York 1962. While I do not wish to be bound by theory it would seem that the ease of the hydrolysis depends to a large extent upon the nature of the bonding, i.e., covalent vs. ionic type bonding.

I have also recognized that based upon the present teaching and another copending application of mine (U.S. Ser. No. 521,901 now U.S. Pat. No. 3,993,491) which is incorporated by reference, one skilled in the art would consider adding or replacing the precious metal ions with non-precious catalytic metal ions (e.g., copper). Other non-precious catalytic metals are well known in the art and they have been recited in many patents, e.g. U.S. Pat. No. 3,011,920. Such attempts will clearly fall within the teaching of this patent and thus the term "catalytic metal" is intended to encompass both precious and non-precious metal ions whose metallic state and/or lower oxidation state would act as a catalytic site for electroless plating initiation.

Hence in its broad sense this invention is not restricted to precious metals as the catalytic metals.

While the use of the tin salts is preferred, substitution of other elements within the same group as of tin would constitute an obvious extension and thus fall within the scope of this invention.

In addition should it be desirable, a wide variety of additives may be incorporated for the stabilization of tin(II) ions; such additives are well known in the art of electroless plating or in the art of electrolytic tin plating.

The following references are believed to be of further assistance.

1. E. Gould, "Mechanism and Structure in Organic Chemistry", Holt, Rinehart, & Winston, Chapter 8, (1959).
2. Swain & Scott, J. Am. Chem. Soc., 75, 141 (1953).

What I claim is:

1. A process for the electroless metal deposition of a non-conductor substrate comprising the steps of:

(1) contacting said substrate with a catalytic colloidal composition prepared by (a) admixing 1. stannous ions in a molar concentration excess to precious metal ions and in a molar concentration excess to readily hydrolyzable stannic ion, with
2. precious metal ions, and
3. a readily hydrolyzable stannic compound which upon heating results in the conversion of the stannic ions to colloidal aged tin(IV) which imparts a colloidal nature to said composition and further wherein the readily hydrolyzable stannic compound is derived from an extraneous source, and
4. an acid, and (b) exposing said admixture to thermal energy whereby converting the stannic ions in said readily hydrolyzable stannic compound to said colloidal aged tin(IV), and in addition said colloidal composition further contains a reducing agent in an inactive state, and (2) contacting the treated substrate with an electroless plating bath.

2. The process according to claim 1 wherein said precious metal ions are palladium.

3. The process according to claim 1 wherein said hydrolyzable stannic ion is derived from stannic chloride.

4. The process according to claim 1 wherein said stannous ions are derived from stannous chloride.

5. The process according to claim 1 wherein said non-conductor is ABS.

6. The process according to claim 1 wherein said acid is hydrochloric acid.

7. The process according to claim 1 wherein said colloidal catalytic composition further contains a nucleophilic agent.

8. The process according to claim 1 wherein said non-conductor is etched prior to the step of contacting the substrate with the catalytic colloidal composition.

* * * * *